United States Patent [19]

Ozaki

[11] Patent Number: 4,832,224

[45] Date of Patent: May 23, 1989

[54] HIGH PRESSURE GAS CARTRIDGES WITH A DOUBLE SAFETY DEVICE

[75] Inventor: Yohoji Ozaki, Misato, Japan

[73] Assignee: Nippon Tansan Gas Co., Ltd., Tokyo, Japan

[21] Appl. No.: 867,237

[22] Filed: May 23, 1986

[30] Foreign Application Priority Data

May 22, 1985 [JP] Japan ..... 60-113289
Jul. 13, 1985 [JP] Japan ..... 60-153385

[51] Int. Cl.[4] ..... F17B 1/14
[52] U.S. Cl. ..... 220/89 A; 220/374
[58] Field of Search ..... 220/89 A, 3, 203, 204, 220/207, 374, DIG. 4, 256, 257, 3

[56] References Cited

U.S. PATENT DOCUMENTS

| | | | |
|---|---|---|---|
| 1,579,141 | 3/1926 | Pierce | 220/89 A |
| 2,576,431 | 11/1951 | White | 220/89 A |
| 2,650,673 | 9/1953 | Bering et al. | 220/371 |
| 2,685,383 | 8/1954 | Kochner | 220/3 |
| 3,080,091 | 3/1963 | Philip | 220/89 A |
| 3,977,560 | 8/1976 | Stumpf et al. | 220/371 X |
| 4,219,126 | 8/1980 | Oana | 220/89 A |
| 4,345,611 | 8/1982 | Ikeda et al. | 220/89 A X |
| 4,349,122 | 9/1982 | Klar et al. | 220/374 X |
| 4,413,746 | 11/1983 | Matsutani | 220/89 A |
| 4,416,388 | 11/1983 | Mulawski | 220/89 A X |
| 4,549,565 | 10/1985 | Short, III | 220/89 A X |

FOREIGN PATENT DOCUMENTS

| | | |
|---|---|---|
| 57-54679 | of 0000 | Japan . |
| 58-27439 | of 0000 | Japan . |

*Primary Examiner*—Steven M. Pollard
*Attorney, Agent, or Firm*—Lackenbach Siegel Marzullo & Aronson

[57] ABSTRACT

A high pressure gas cartridge having a sealing plate and a gas pressure regulator under the sealing plate in the passage for the gas. The cartridge is charged through a clearance space provided between the sealing plate or the gas regulator and the cartridge wall. The regulator operates when the inner pressure rises excessively and prevents the cartridge from rupturing or moving by permitting the gas to gradually eject through an orifice therein. The regulator controls the gas flow so that it is sufficient for a device employing the gas, but not sufficient to cause the cartridge to move or fly by reaction when the sealing plate is broken and permits the gas to freely flow out.

8 Claims, 2 Drawing Sheets

HIGH PRESSURE GAS CARTRIDGES WITH A DOUBLE SAFETY DEVICE

BACKGROUND OF THE INVENTION

1. Field of the Invention

A high pressure gas cartridge gives occasion to moving or flying as the flow of the inner gas may be when the cartridge is in distribution or in use, and this is very dangerous. The causes of moving or flying of the cartridge are as follows. The first is the case when the cartridge has been thrown into fire and the sealing plate has exploded by the excessive inner pressure, the second is when the sealing plate has been pierced by a boy's mischief with a nail, and the third is when the cartridge in which the gas remains has come off the piercing device. The present invention relates to high pressure gas cartridges which are safety in such conditions.

2. Prior Art

Heretofore, the Japanese patent publication No. 57(1982)-54679 is known in public, which discloses a high pressure gas cartridge with a safety device. The device is provided with a small room having an orifice under the sealing plate, and is so planned as not to produce a rocketing or jetting gas stream, by throttling the gas by the orifice when it becomes high temperature and the sealing plate is broken. The orifice, however, has an object to flow gradually the gas of which pressure becomes high at high temperature, so it cannot be used practically as the sectional area of the orifice is very small and also quantity of flowing gas under the inner pressure at the normal temperature is very small. If, in this type, using at the normal temperature is made to be capable, both the sealing plate and the small room with the orifice must be pierced, and which needs strong force and a long stroke of a piercing pin. This is also out of practical use.

Further, the Japanese patent publication No. 58 (1983)-27439 is also known in public, which discloses a gas cartridge having an orifice in an opening. In this type of cartridge, however, interest is directed only to controlling quantity of flow of gas, and consideration to the work of charging gas into cartridges is insufficient, then it takes long time to charging gas. Accordingly, quantity of production of cartridges per hour is limited, so that it is unavoidable to increase the cost of production.

SUMMARY OF THE INVENTION

An object of the present invention is to provide high pressure gas cartridges with a double safety device, which can be charged speedily with gas, which can be staved off a rupture of the cartridge when the inner pressure has increased excessively, which do not move or fly by reaction even if the sealing plate has been pierced manually and the cartridges have become such a state as the inner gas can flow out freely into atmosphere, and which in general use can flow a necessary quantity of gas, by piercing the sealing plate.

Another object of the present invention is to minimize force to be added to and a stroke of a piercing pin for the sealing plate.

A further object of the present invention is to let allot the safety function to the safety device of the sealing plate when the inner pressure has increased excessively and to a gas regulator when the inner gas flows freely after the sealing plate has been broken.

The foregoing objects and other objects as well as the characteristic features of the invention will become more apparent and more readily understandable by the following description and the appended claims when read in conjunction with the accompanying drawings.

BRIEF DESCRIPTION OF THE DRAWINGS

The drawings show embodiments of the present invention, and throughout the drawings, the same muneral shows the corresponding portion.

DETAILED DESCRIPTION OF THE INVENTION

1 is a body of capacity less than 100 cc and into the body 1 a high pressure gas, such as $CO_2$ or $O_2$, is charged. There are types of the body 1, one of which has a shoulder 12 on the inner wall around an opening 11 (FIGS. 1, 3, 5 and 9) and the other has not such a shoulder (FIGS. 6, 7, 8, 11 and 13).

Figure 7:
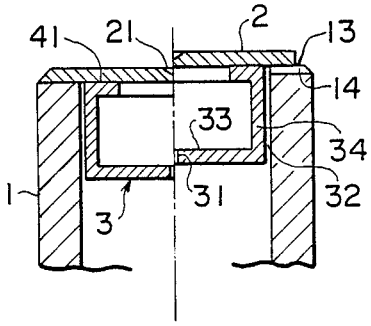
FIG. 7 is a similar sectional side view of a further embodiment.
Figure 6:
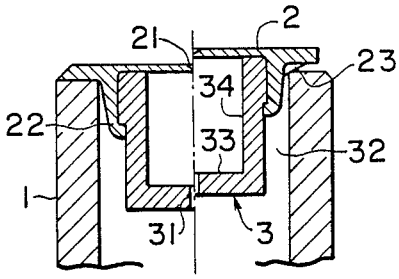
FIG. 6 shows a sectional side view of a further embodiment similar to FIG. 1.

2 is a sealing plate, which is a usual safety type having a limited recess 21 to escape the inner pressure through a hair crack when the inne pressure rises excessively. The sealing plate 2 also has the types, one of which has a circular leg 22 on its underside (FIGS. 1, 3, 5, 6, 8, 9, 11 and 13) and the other has not such a circular leg (FIG. 7).

These sealing plates 2 are all put on the outer plane 13 of the opening 11 of the body 1, and gas is charged into the body 1 through a clearance formed by means of radial protrusions 23 of the sealing plates 2 or radial grooves 14 in the outer plane 13 of the body 1. After which the sealing plates 2 are joined as before, such as welded or calked, onto the body 1.

3 is a regulator for quantity of flowing gas through the regulator. The body 1 is provided with the regulator 3 this side of the sealing plate 2 on a passage of flowing gas. The regurator 3 has an orifice 31 to throttle quantity of gas at the normal temperature within not to move or fly the cartridge by reaction of gas emission, and also has a clearance 32 for charging gas around itself. The regulator 3 may be of a plate, and in the examples shown in the drawings the regulator 3 takes the form of a cylinder having the bottom wall 33 and a side wall 34.

The clearance 32 also has types, one of which is presented by the periphery of the regulator 3 (FIGS. 6 to 8, 11 to 13), and the other by radial ribs 35 (FIGS. 1 to 5, 9, 10). The clearance 32 may be formed as radial grooves. At all events it is good if the crearance 32 is formed when the regulator 3 is placed in the body 1. There are cases of the disposition of the regulator, such as to put the regulator on the showlder 12 on the body 1 (FIGS. 1, 3, 5, 9), to carry it by calking the lower end of the circular leg 22 of the sealing plate 2 (FIG. 6), to unite the regulator and the sealing plate in a body by a soldered portion 41 formed by soldering directly to the sealing plate 2 (FIG. 7), to press the upper portion with respect to the sealing plate 2 (FIGS. 8 and 13), to fix the regulator to the sealing plate in a body (FIG. 11), etc.

Figure 8:
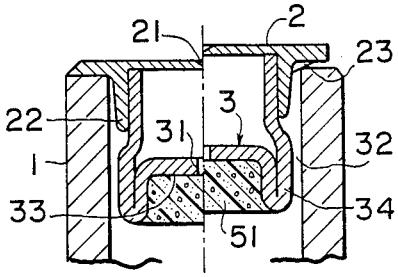
FIG. 8 is a similar sectional side view of a further embodiment.

FIG. 8 shows the case where a filter 51 is inserted in the underside of the orifice 31 so that the orifice 31 may not be clogged with residual swarf in the body. The filter 51 does not have the regulating function which is correspondent with one of the orifice 31. Though the filter is not shown in FIGS. 1 to 7, even in these cases, the same effect can be obtained by providing such a filter onto the underside of the orifice.

Figure 9:
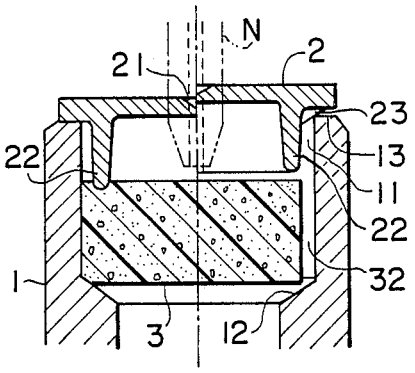
FIG. 9 is a side view, in which a filter is used as a regulator, and which is similar to FIG. 1 and is sectioned along its line C—C of FIG. 10.
Figure 11:
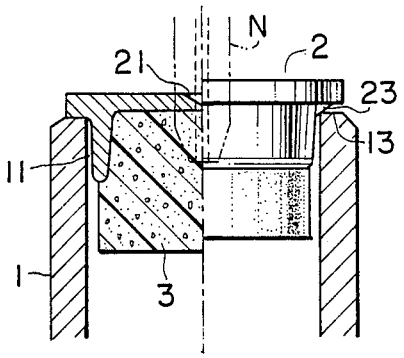
FIG. 11 is a side view of a further embodiment similar to FIG. 1, in which the right sides of the sealing plate and the regulator of the center line are not sectioned.
Figure 10:
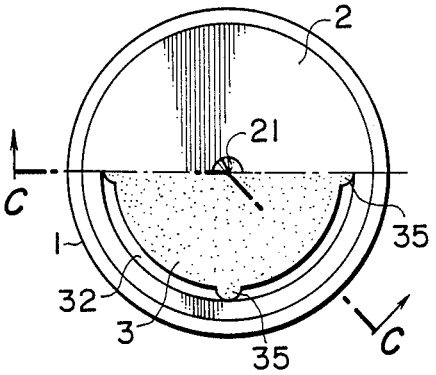
FIG. 10 is a plan in which the underside of the center line of the sealing plate is taken out.
Figure 12:
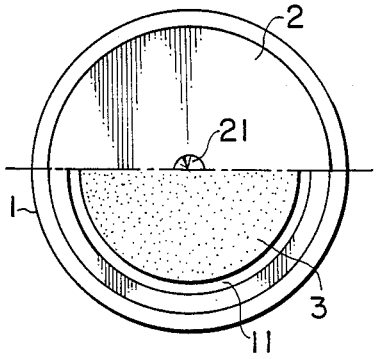
FIG. 12 is a plan in which the underside of the center line of the sealing plate is taken out.

FIG. 9 and below are the cases where a filter is used as the regulator, which is essentially different from the filter 51 in FIG. 8. The filter is the type of meshes of continuous foam, and the meshes are adapted for a kind or pressure of gas. The filter regulates quantity of flow of gas, singly or in cooperation with the orifice 31, as follows: The quantity is enough for acting a device using the gas, for example an oxygen inhaler, but is not enough to move the cartridge by reaction even if the cartridge is in a state where the sealing plate has been broken and the gas can flow out freely.

Figure 13:
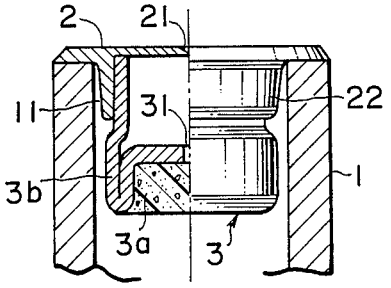
FIG. 13 is a sectional side view similar to FIG. 1 of a further embodiment in which the regulator is composed of a portion with an orifice and a filter portion.

FIG. 13 is the case where the regulator 3 is consisted of a cylinder portion **3*b* with the orifice 31 and a filter portion 3*a*. It is of course that quantity of flow of gas through both portions is determined as stated above. In this case the thickness of the filter portion 3*a*** can be thinned.

When gas has been charged in the body and the sealing plate 2 has been joined onto the body 1, in several embodiments, it is necessary to make the function of the regulator perfect, to check the inside of the body 1 from leading directly to the corresponding portion to the limited recess 21 of the sealing plate through the clearance 32.

Figure 1:
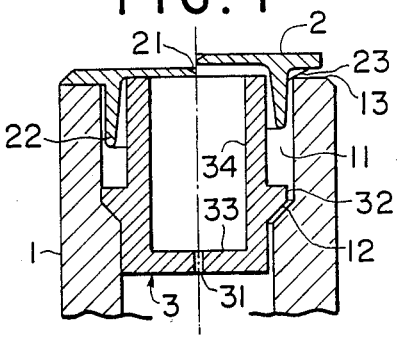
FIG. 1 is a side view which shows an embodiment of an opening portion of a cartridge of the present invention, in which the right side of the center line shows in the former state and the left side of the center line shows in the after state of joining a sealing plate to the bode, and which is sectioned along the line A—A of FIG. 2.
Figure 3:
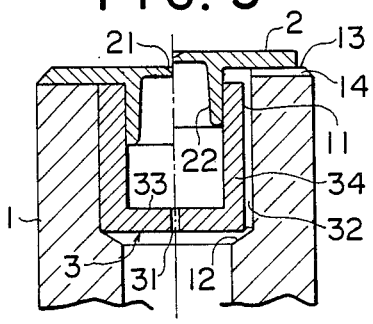
FIG. 3 is a side view of another embodiment similar to FIG. 1, which is sectioned along the line B—B of FIG. 4.
Figure 2:
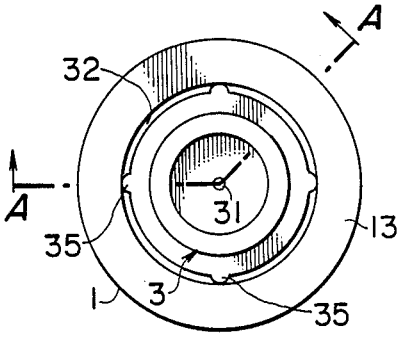
FIG. 2 is a plan view in which the sealing plate of FIG. 1 is not joined.
Figure 4:
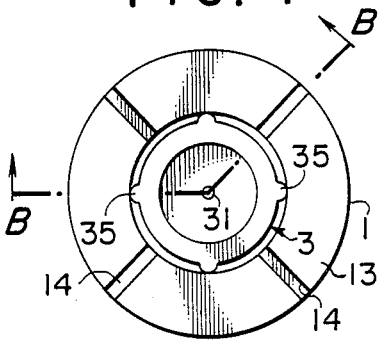
FIG. 4 is a plan in which the sealing plate of FIG. 3 is not joined.
Figure 5:
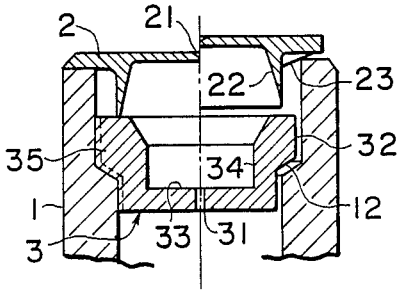
FIG. 5 shows a sectional side view of a further embodiment similar to FIG. 1.

Therefore, in FIG. 1, the top of the regulator 3 is pressed onto the underside of the sealing plate 2, in FIG. 3, the upper inner portion of the regulator is closely fitted onto the periphery of the circular leg 22, and in FIGS. 5 and 9, the lower portion of the circular leg 22 is pressed into the legulator 3.

To use the cartridge shown in the drawings, piercing only the sealing plate 2 will suffice after the cartridge has been attached to a piercing device. Also in FIG. 11, by employing such material of the regulator as a needle N for piercing is easy to pierce, force to press the needle N and a stroke of it can be minimized. By the piercing, a necessary quantity of the inner gas is taken out through the regulator.

When the cartridge is overheated, by throwing into fire in error or by a fire, the inner gas inflates and the inner pressure increases. At a certain height, the sealing plate 2 begins to bend outwardly, and then a hair crack arises through the bottom of the limited recess. The gas in the body begins to flow out gradually through the crack and the body 1 is staved off its exprosion. Also when, at the normal temperature, the sealing plate 2 is pierced by mischief or the cartridge having the residual gas comes off the piercing device, quantity of gas is kept fixed by the regulator 3 so that the cartridge does not fly and damage is not given to men and beasts or structures.

The diameter of the orifice 31 not to make the cartridge fly is in the case of $CO_2$ gas as follows.

| Calculating condition | |
|---|---|
| Subject works: | 10 cc, 50 cc, 95 cc. |
| Capacities of cartridges | |
| Values of propellent force: | 10 cc-30 g, 50 cc-15 g, |
| (criterion is total weight) | 95 cc-270 g. |
| Working temperatures: | 20° C., 100° C., 150° C. |
| Subject gas: | (charging ratio) 1.34 |
| Carbonic acid gas ($CO_2$) | |

Calculation (provided that P: pressure kg/cm$^2$, d: diameter mm, f: inital quantity of flow l/s and charging ratio (1.34)

| Subject works | propellent forces | | Temperatures 20° C. | 100° C. | 150° C. |
|---|---|---|---|---|---|
| 10 cc | 30 g | p | 60 | 388.4 | 602.0 |
| | | d | 0.225 | 0.089 | 0.071 |
| | | f | 0.96 | 0.48 | 0.43 |
| 50 cc | 150 g | p | 60 | 388.4 | 602.0 |
| | | d | 0.504 | 0.198 | 0.159 |
| | | f | 4.81 | 2.41 | 2.15 |
| 95 cc | 270 g | p | 60 | 388.4 | 602.0 |
| | | d | 0.676 | 0.266 | 0.213 |
| | | f | 8.66 | 4.33 | 3.87 |

From the above calculation, the diameter of the orifice 31 is decided as follows.

| | 20° C. | 100° C. | 150° C. |
|---|---|---|---|
| 10 cc | 0.20 | 0.08 | 0.07 |
| 50 cc | 0.50 | 0.19 | 0.15 |
| 95 cc | 0.65 | 0.26 | 0.21 |

It will be understood that the diameter of the orifice 31, which does not permit flying of the cartridge even if the sealing plate is broken by a rise in temperature, varies in accordance with weight of the cartridge though it is not limited within the above calculation if gas to be used and charging ratio are changed.

In the invention as regulation of quantity of flow of gas when the inner pressure rises exessively is left to a crack through the recess 21, the diameter of the orifice 31 of the regulator 3 and meshes of the filter can be set so that they can secure effective quantity of flow at the usual temperature.

Next, referring to a charging time, the diameter is about 0.6 mm in the case of 0.3 mm$^2$ as an example among sectional areas of the orifice from 0.03-0.3 mm$^2$, which are cited by the inventor. According to experiments by the inventor, the time spended for charging $CO_2$ gas of some 60 g in the cartridge having a capacity of 95 cc is about 3.4 seconds in case of the orifice of 0.6 mm in diameter only, and is 1.4 seconds in case of the present invention in which the gas is charged through the clearance 32 between the regulator 3 and the body 1. Indeed, the gas has been charged at speed by 2.4 times and more.

I claim:

1. A high pressure gas cartridge having dual safety elements, one of which is a safety sealing plate of conventional type, and provided with a second safety device to reduce excessive pressure in the cartridge, said sealing plate fitted into a charging opening in the cartridge, and said second safety device comprising a gas regulator supported under the sealing plate for regulating the flow of gas comprising:

(a) a clearance space between the regulator and the sealing plate and the wall of the cartridge through which the cartridge may be charged with gas; and (b) a regulator having an orifice of such diameter to limit the gas flow to exceed a predetermined amount for actuating apparatus using the gas but less than the amount required to move the cartridge by reaction when the sealing plate is punctured and permits the gas to escape from the cartridge safely, said regulator is in the form of a cylinder the lower end of which is closed by a bottom wall having said orifice therein, said cylinder being supported on a shoulder on the inside of the cartridge and with the lower end and bottom wall with said orifice being located below said shoulder, and said cylinder further having a cooperatively shaped shoulder, wherein said sealing plate is joined to said cartridge to close off said clearance space and prevent the gas in the cartridge from reaching said regulator under said sealing plate and bypassing said orifice.

2. A high pressure gas cartridge as in claim 1, wherein said regulator is a column-shaped filter having meshes of continuous foam, such filter being supported on a shoulder on the inside of the cartridge, and said sealing plate being joined to said cartridge to close off said clearance space and prevent the gas in the cartridge from reaching said regulator under said sealing plate and bypassing said orifice.

3. A high pressure gas cartridge as in claim 1, wherein said regulator is joined to said sealing plate to isolate said clearance space from said regulator.

4. A high pressure gas cartridge as in claim 1 wherein a circular leg in the top of said cartridge is pressed around said regulator to isolate said clearance space from said regulator.

5. A high pressure gas cartridge as in claim 1, wherein said clearance space is isolated from said regulator by a circular leg in the top of the cylinder pressed around the upper inner face of the regulator.

6. A high pressure gas cartridge as in claim 2, wherein the bottom wall of said cylinder has a cavity on the underside thereof and a coarse mesh filter is provided in said cavity.

7. A high pressure gas cartridge as in claim 1 wherein said regulator is a cylinder the lower end of which is closed by a wall having an orifice therein and the upper end of which is affixed to said sealing plate, said clearance space being closed off by said sealing plate to prevent the gas in the cartridge from reaching said regulator and bypassing said orifice.

8. A high pressure gas cartridge having dual safety elements, one of which is a safety sealing plate of conventional type to seal an opening in the cartridge, and being provided with a second safety device to reduce excessive pressure in the cartridge comprising:

a gas regulator supported under the sealing plate for regulating the flow of gas, when the sealing plate is punctured and permits the gas to escape from the cartridge, said gas regulator having an orifice of such diameter to limit the gas flow to exceed a predetermined amount for actuating apparatus using the gas but less than the amount required to move the cartridge by reaction when the sealing plate is punctured at the normal temperature and permits the gas to escape from the cartridge safely, said regulator is in the form of a cylinder the lower end of which is closed by a bottom wall having said orifice therein, said cylinder being supported on a shoulder on the inside of the cartridge and with the lower end and bottom wall with said orifice being located below said shoulder, and said cylinder further having a cooperatively shaped shoulder, wherein said sealing plate is joined to said cartridge to close off said clearance space and prevent the gas in the cartridge from reaching said regulator under said sealing plate and bypassing said orifice.

* * * * *